US011313557B2

(12) United States Patent
Al-Amer et al.

(10) Patent No.: US 11,313,557 B2
(45) Date of Patent: Apr. 26, 2022

(54) BURN PIT FLARE TIP STRUCTURE

(71) Applicant: SAUDI ARABIAN OIL COMPANY, Dhahran (SA)

(72) Inventors: Hamid A. Al-Amer, Al-Ahsa (SA); Khalid Abdullah Al-Jumayiah, Al-Ahsa (SA); Hussain S. Al-Nassir, Al-Ahsa (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 192 days.

(21) Appl. No.: 16/903,232

(22) Filed: Jun. 16, 2020

(65) Prior Publication Data

US 2021/0388983 A1 Dec. 16, 2021

(51) Int. Cl.
*F23G 7/08* (2006.01)
*F23M 5/00* (2006.01)

(52) U.S. Cl.
CPC ..... *F23G 7/08* (2013.01); *F23M 5/00* (2013.01); *F23D 2900/00018* (2013.01); *F23M 2900/05004* (2013.01)

(58) Field of Classification Search
None
See application file for complete search history.

(56) References Cited

U.S. PATENT DOCUMENTS 3,822,983 A 7/1974 Proctor et al.
4,065,248 A 12/1977 Straitz, III et al.

OTHER PUBLICATIONS

Shore; Burn Pits Criteria for Design, Sizing, Site Selection and Construction; available at https://www.geocities.ws/flareman_xs/Systems/BURN_PIT_CRITERIA.pdf, Aug. 21, 2018.
Descriptive photographs of Burn Pits; available at http://www.flaregas.com/burnpits.html, Aug. 21, 2018.
Vapor Recovery Unit; available at https://fabianologi.wordpress.com/2008/05/26/vapor-recovery-unit/, Aug. 21, 2018.
Burn-Pit Flares, available at https://www.zeeco.com/flares/flares-ground-burn-pit.php, Aug. 21, 2018.
Burn Pit, available at http://tcd-italia.com/products?id=13, Aug. 21, 2018.
Gas Flares Information, available at https://www.globalspec.com/learnmore/manufacturing_process_equipment/air_quality/gas_flares, Aug. 21, 2018.
Flare and vent disposal systems, available at http://petrowiki.org/Flare_and_vent_disposal_systems, Aug. 21, 2018.
ITAS burn pit flares, available at https://combustion.fivesgroup.com/products/itas-product-line/flares/burn-pit-flares.html, Aug. 21, 2018.

*Primary Examiner* — Jason Lau
(74) *Attorney, Agent, or Firm* — Leason Ellis LLP

(57) ABSTRACT

A robust, thermally and structurally sound burn pit flare tip structure is disclosed of refractory brick construction capable of resisting the high temperature of 1800° C. and associated fluctuations. The burn pit is capable of prolonged continuous operation and reduces the previously experienced downtime and frequent failures.

15 Claims, 7 Drawing Sheets

BURN PIT FLARE TIP STRUCTURE

RELATED APPLICATIONS

Not applicable.

BACKGROUND

Field of the Invention

This disclosure relates to hydrocarbon burn pits, and particularly to burn pit flare tip structures.

Description of Related Art

A hydrocarbon burn pit is a shallow depression or pool structure intended to contain flares for combustion of hydrocarbon liquids or mixed liquid/vapor streams, which are discharged from units such as processing plants, pipelines or pumping stations. The discharges are during offset conditions or other abnormalities. The burn pit can also be used on an intermittent basis when blowing down pipelines or vessels. Accordingly, the hydrocarbon burn pit is an essential auxiliary component to refineries worldwide.

A burn pit flare tip structure (sometimes referred to as a "flare tip box" or "flare tip concrete box") is a masonry wall structure that contains the burn pit tip and the flares that emit therefrom. The flare tip structure includes a cast concrete structure forming the initial containment are for the flares, with a protective wall as the exposed face of masonry construction, such as refractory bricks and/or refractory tile blocks. The masonry wall surfaces are directly exposed to the flares with combustible materials further fueling the flares, causing high temperatures up to and exceeding 1800° C. Further wide thermal gradients occur during upset operation conditions. The extremities and gradients are known to degrade the masonry structure, for instance by dislodging of the burn pit wall bricks and/or tiles, cracking of refractory linings and other materials, and misalignment. Over time this leads to collapse of the burn pit wall, leaving the burn pit tip unprotected and exposed to high temperature, and necessitating repairs or reconstruction. Further, maintenance is typically conducted every 2-4 years. Accordingly, since the refinery cannot operate without the emergency burn put in place, it is not uncommon to have plural burn pits, so that while one is undergoing maintenance, repair or reconstruction, the other can be deployed. This has become a standard industry practice, and as such this aspect of refineries and other operations has not been subjected to efforts to optimize their construction.

Therefore, a need exists for more robust, thermally and structurally sound burn pit flare tip structures.

SUMMARY

The above objects and further advantages are provided by the burn pit flare tip structures disclosed herein. The structures comprise one or more features that minimize the likelihood of dislodging of the burn pit wall bricks and premature failure of the burn pit tip tile blocks.

In certain embodiments, a flare tip structure for a burn pit flare tip that is exposed is provided, comprising:

a burner shaft having a first end coupled to the exposed burn pit flare tip, wherein during operation the burner shaft is in fluid communication at a second end with a source of combustible material;

a burner wall having an exposed surface of refractory bricks and refractory precast units, and having the flare tip extending and exposed therefrom, the burner wall being oriented generally vertically or slightly inclined, being in a base planar direction, and including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall;

a first wing wall and second wing wall each having an exposed surface and including a refractory concrete wall and an adjacent refractory brick wall forming part of the exposed surface of the wing walls, wherein the first and second wing walls are contiguous with, and on opposing sides of, the burner wall, which are each of decreasing height as the distance from the burner wall increases, the first and second wing walls are oriented generally vertically, the first and second wing walls have planar orientations that differ from the base planar direction so that the contiguous burner wall and first and second wing walls form an initial containment area, and the intersection of the first wing wall and the burner wall, and the intersection of the second wing and the burner, wall comprises a plurality of obtuse angles to form a contoured inside corner;

and a ground surface of the initial containment area between the contiguous tip support wall portion and the first and second wing wall portions, and the pit discharge area.

In certain embodiments, a flare tip structure for a burn pit flare tip that is exposed is provided, comprising:

a burner shaft having a first end coupled to the exposed burn pit flare tip, wherein during operation the burner shaft is in fluid communication at a second end with a source of combustible material;

a burner wall having an exposed surface of refractory bricks and refractory precast units, and having the flare tip extending and exposed therefrom, the burner wall being is oriented generally vertically or slightly inclined, being in a base planar direction, and the tip support wall including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall, wherein the head portion of the tip support wall portion is inclined away from the end of the burn pit flare tip by stepped courses of refractory brick, wherein the burner wall or the head portion of burner wall is formed without metal anchors, wherein refractory bricks in the burner wall are separated by cardboard expansion joints of a thickness in the range of 0.8 to 1.2 millimeters arranged at cross joints between every two bricks, and wherein the overall joint thicknesses for the bed joints and the cross joints are in the range of 1.6 to 2.4 millimeters;

a first wing wall and a second wing wall each having an exposed surface and including a refractory concrete wall and an adjacent refractory brick wall forming part of the exposed surface of the wing walls, the first and second wing walls being contiguous with, and on opposing sides of, the burner wall, which are each of decreasing height as the distance from the burner wall increases, and wherein the first and second wing walls are each oriented generally vertically, and wherein the planar orientations of the first and second wing walls differ from the base planar direction so that the contiguous burner wall and first and second wing walls form an initial containment area;

and a ground surface of the initial containment area between the contiguous tip support wall portion and the first and second wing wall portions, and the pit discharge area.

In certain embodiments, a flare tip structure for a burn pit flare tip that is exposed is provided, comprising:

a burner shaft having a first end coupled to the exposed burn pit flare tip, wherein during operation the burner shaft is in fluid communication at a second end with a source of combustible material, and wherein the exposed burn pit flare tip comprises an extractable sleeve that is inserted within the end of the burner shaft and attached to an outside perimeter of the burner shaft with retaining clips;

a burner wall having an exposed surface of refractory bricks and refractory precast units, and having the flare tip extending and exposed therefrom, the burner wall being oriented generally vertically or slightly inclined, being in a base planar direction, and including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall;

a first wing wall and second wing wall each having an exposed surface and including a refractory concrete wall and an adjacent refractory brick wall forming part of the exposed surface of the wing walls, wherein the first and second wing walls are contiguous with, and on opposing sides of, the burner wall, which are each of decreasing height as the distance from the burner wall increases, the first and second wing walls are oriented generally vertically, and the first and second wing walls have planar orientations that differ from the base planar direction so that the contiguous burner wall and first and second wing walls form an initial containment area;

and a ground surface of the initial containment area between the contiguous tip support wall portion and the first and second wing wall portions, and the pit discharge area.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where:

FIG. 9 is a section view of the burn pit flare tip structure of FIG. 8;

DETAILED DESCRIPTION

Figure 1:
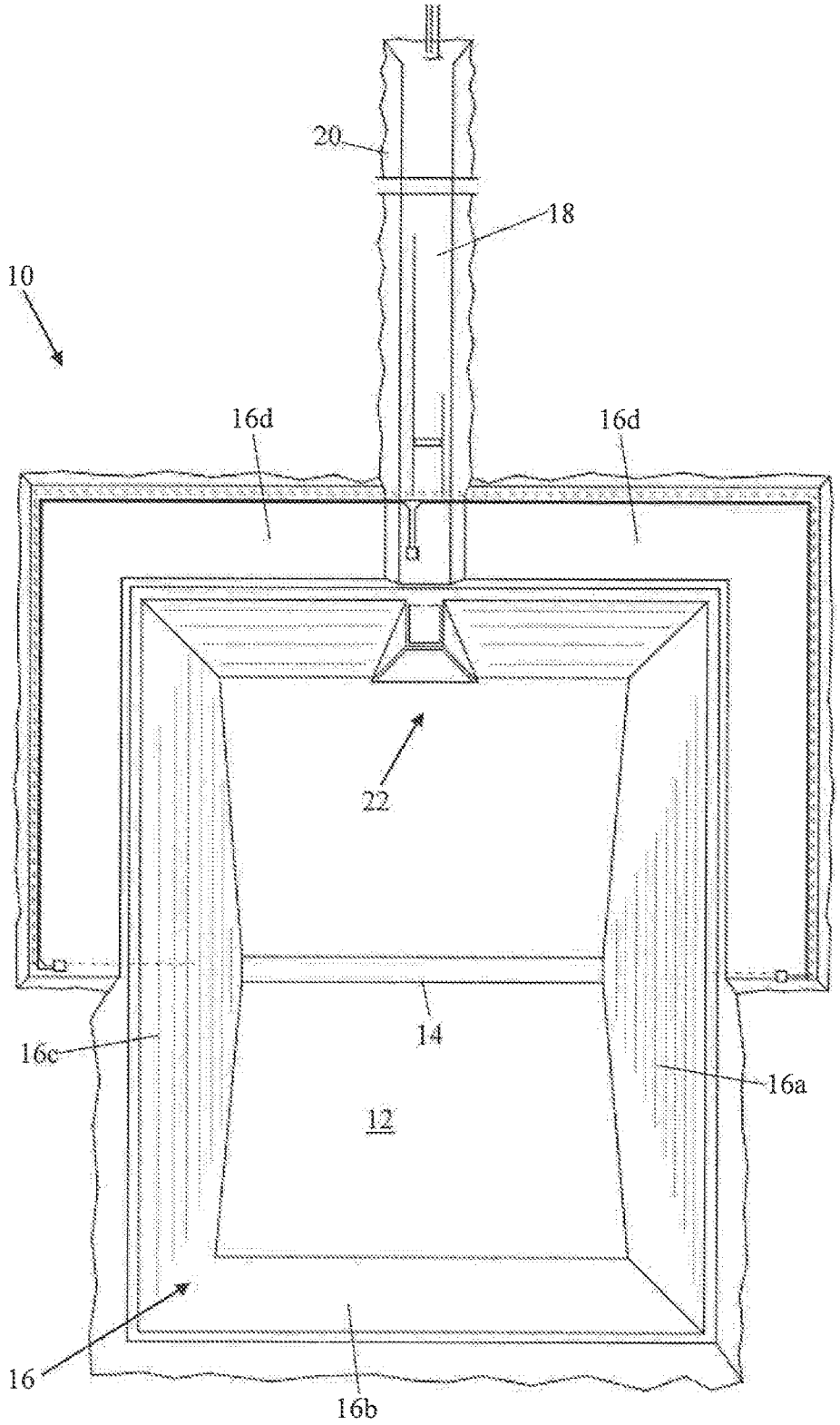
FIG. 1 (Prior Art)
FIG. 1 is a plan view of a hydrocarbon burn pit.
Figure 2:
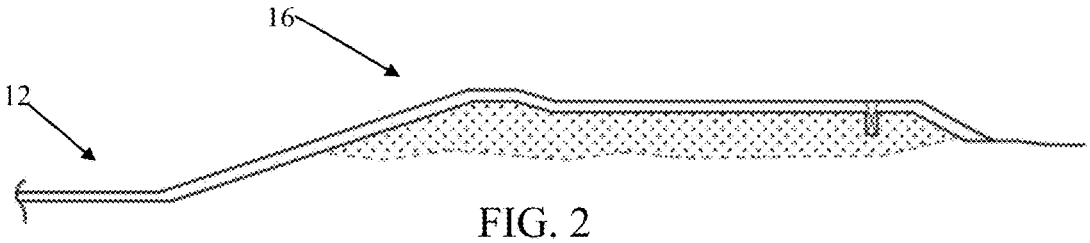
FIG. 2 (Prior Art)
FIG. 2 is a section view of a berm portion of the hydrocarbon burn pit.
Figure 3:
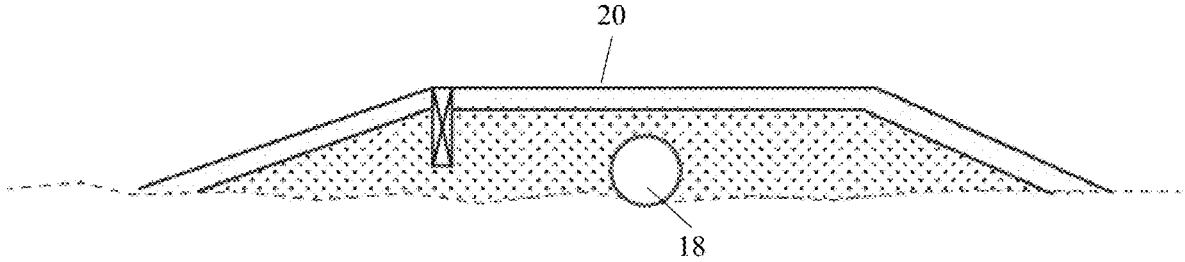
FIG. 3 (Prior Art)
FIG. 3 is a section view of a burner shaft enclosed in a protective mound that forms part of the hydrocarbon burn pit.

FIGS. 1-3 depict a hydrocarbon burn pit to show the context in which the burn pit flare tip structures disclosed herein are used. FIG. 1 depicts a plan view of the overall hydrocarbon burn pit, FIG. 2 depicts a section view of a berm portion of the hydrocarbon burn pit and FIG. 3 depicts a section view of a burner shaft enclosed in a protective mound that forms part of the hydrocarbon burn pit. A hydrocarbon burn pit 10 includes a pool area 12 that is contained entirely on three sides, and partially on a fourth side, by a berm 16 having portions 16*a*, 16*b*, 16*c* and 16*d*. The pool area 12 has opposing ground portions sloping to a center depression 14 that spans across the pool area 12, shown in FIG. 1 between berm portions 16*a* and 16*c*. In certain embodiments a suitable configuration and overall dimensions for a pool area 12 used in a commercial refinery or plant (including the outside of the berms) include a rectangular area having a length (corresponding to the berm portions 16*a* and 16*c*) of about 80-100, 85-100, or 90-100 meters, and a width (corresponding to the berm portions 16*b* and 16*d*) of about 60-80, 65-80, or 70-80 meters. The berm portions have a slope typical of inner dikes, for instance of about 2:1-4:1, 2.5:1-4:1 or about 3:1, with the widths of the berm portions 16*b* and 16*d* being about 6-12, 8-12 or 9-12 meters, and the widths of the berm portions 16*a* and 16*c* varying along the length with narrowest portions at each end of about 6-12, 8-12 or 9-12 meters, and the widest portion at the center of about 9-14, 10-14 or 11-14 meters.

A burner shaft 18 is exposed at a first end with a burn pit tip, extending to a second end that in operation is in fluid communication with a source of hydrocarbon liquids (not shown). The burner shaft 18 is buried under a protective mound 20 extending to the pool area 12, with a flare tip projecting from the berm portion 16*d* in a burn pit flare tip structure 22 to discharge flares and hydrocarbons into the pool area 12.

Figure 4:
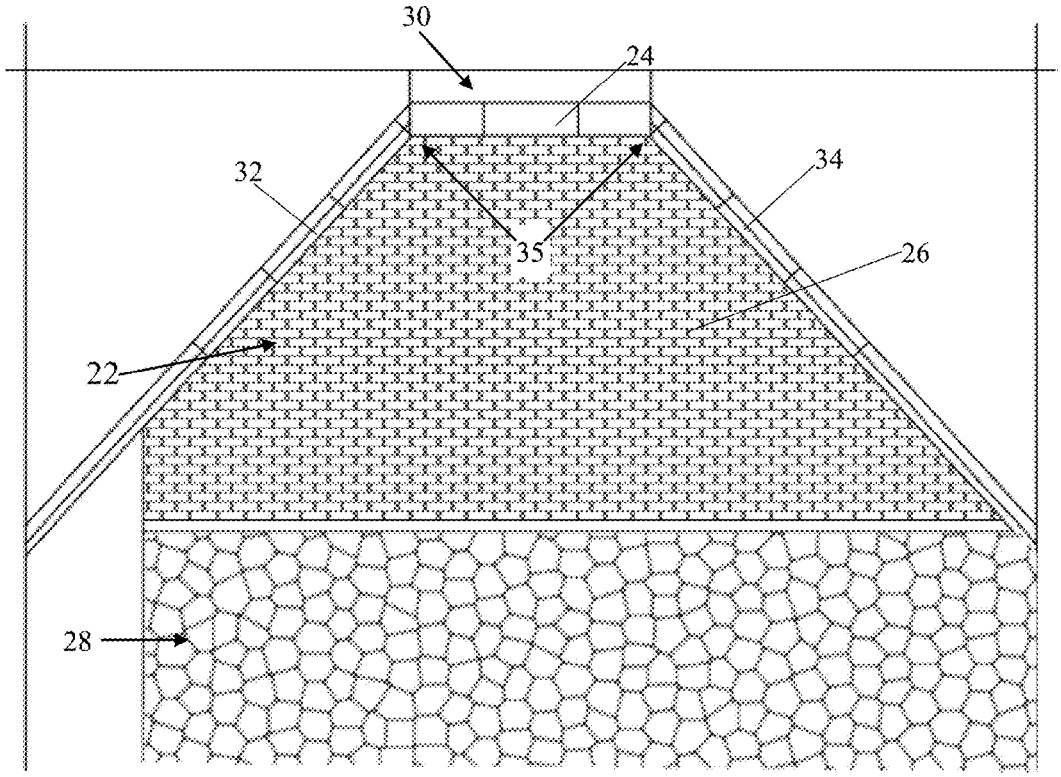
FIG. 4 (Prior Art)
FIG. 4 is a partial plan view of a portion of a conventional burn pit flare tip structure.
Figure 5:
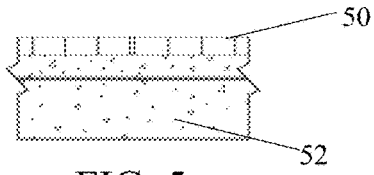
FIG. 5 (Prior Art)
FIG. 5 is a detail section view of the floor of the structure shown in FIG. 4.
Figure 6:
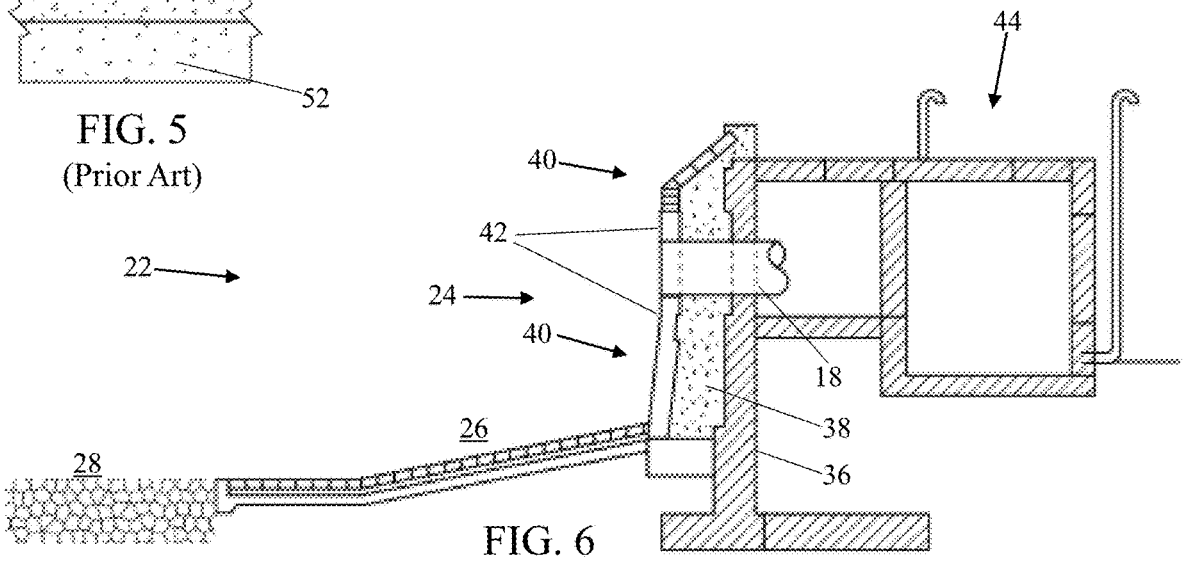
FIG. 6 (Prior Art)
FIG. 6 is a section view of the structure shown in FIG. 4.
Figure 7:
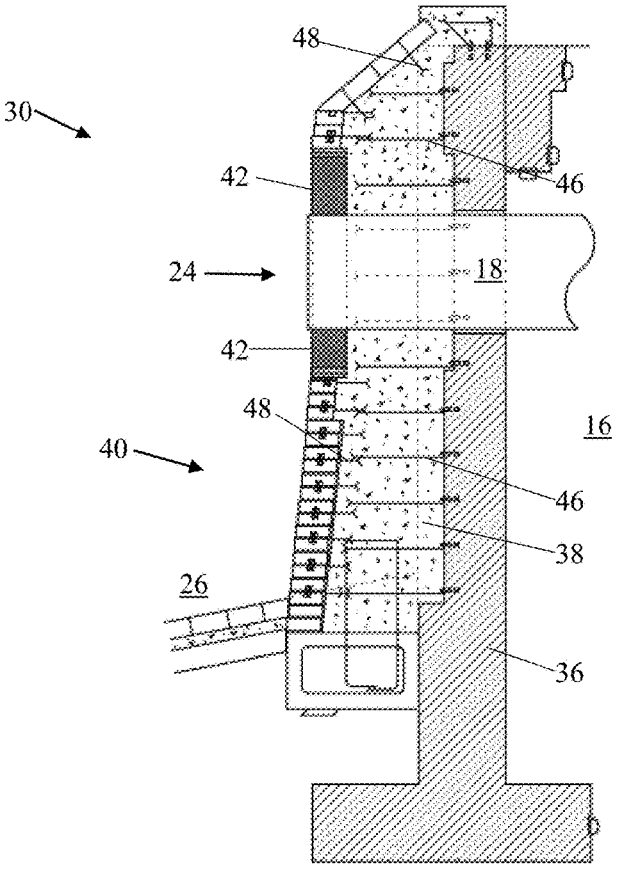
FIG. 7 (Prior Art)
FIG. 7 is a section view of the wall of the structure shown in FIG. 4.

FIGS. 4-7 show a conventional flare tip structure, where FIG. 4 is a partial plan view, FIG. 5 is a detail section view of the floor, FIG. 6 is a section view, and FIG. 7 is a section view of the wall. The burn pit flare tip structure 22 includes the burner shaft 18 (FIGS. 1, 3, 6, 7) extending substantially horizontally through a utility box 44 (FIG. 6), and is in fluid communication with source of a combustion material to a burn pit flare tip 24 (FIGS. 6, 7). The discharge tip 24 is exposed to an initial containment area 26 (FIGS. 4, 6, 7) which is sloped away from the flare tip so that liquids drain from to the pool area 12, typically through a flow breaker region 28 (FIGS. 4, 6). The ground surface of the initial containment area 26 can be formed by a refractory brick layer 50 and a reinforced concrete layer 52 atop compressed, graded and sloped fill (FIG. 5). In conventional designs the brick layer is formed with the bed of the bricks on the surface, as a paver design, with the header and stretcher faces of the bricks adjacent to one another.

As depicted in FIG. 4, adjoined walls form a partial trapezoid shape with obtuse angles where the walls meet. That is, the adjoined walls can be viewed as a base and two legs surrounding the initial containment area 26, where an imaginary base of greater dimension is across the flow breaker region 28. Surrounding the flare tip 24 is a burner wall 30 (for instance corresponding to the shorter base of the partial trapezoid), a first wing wall 32 on a first side of the burner wall 30, and a second wing wall 34 on a second side of the burner wall 30 (wherein the wing walls 32, 34 corresponding to the legs of the partial trapezoid). For example, to accommodate a burner shaft having an outside diameter of about 0.7-1, 0.75-1, 0.8-1, 0.7-0.9, 0.75-0.9, or 0.8-0.9 meters, suitable dimensions include: a burner wall height of about 2-2.8, 2-2.6 or 2-2.4 meters; a burner wall length of about 4-6, 4-5 or 4-4.7 meters; wing walls of approximately equal height dimensions having a maximum height where it meets the burner wall at an obtuse angle similar to the height of the burner wall, and sloping to the ground level or within about 0-1 or 0-0.5 meters from the ground level; and wing walls of approximately equal length dimensions of about 5-7, 5-6.5 or 5-6 meters. The angles of intersection between the plane of the tip support wall 30 and the wing walls 32, 34 are obtuse and are typically identical, for instance in the range of about 120-150, 120-140 or 130-140 degrees.

Figure 8:
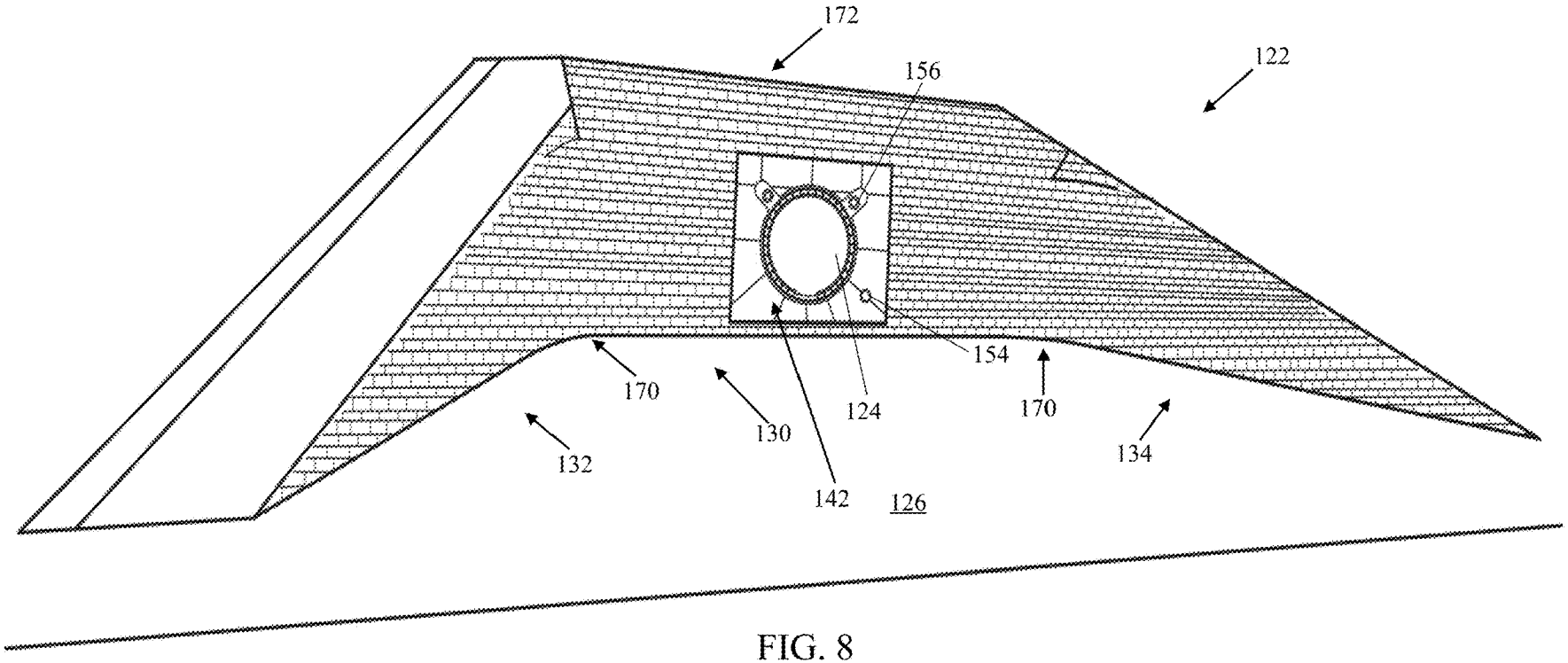
FIG. 8 is a front isometric view of a burn pit flare tip structure according to the present disclosure.

As depicted in FIGS. 7 and 8, the burner wall 30 is a generally vertical or inclined wall section below and partially above the flare tip, in certain embodiments vertical (gradient=∞) or in certain embodiments with a slight gradient inclined away from the face. For example the burner wall 30 can have a height to depth gradient Y:X of about ∞-8:1, ∞-10:1 or ∞-12:1. Above the flare tip the wall is steeply sloped away from the face (for example having a height to depth gradient Y:X of about 0.8:1-1:0.8 or 0.9:1-1:0.9). The steeply sloped portion above the flare tip is formed with the refractory brick laid in a manner so that their faces are on the same plane. In certain conventional designs, the area above the flare tip is vertical or substantially vertical, for instance having the same gradient as the remainder of the wall.

The burner wall 30 typically includes an innermost retaining wall layer 36 adjacent to compacted earthen material forming the berm 16, a cast refractory concrete layer 38 and a refractory brick layer 40. Below the burn pit flare tip 24 the brick layer 40 is stepped to form the slight gradient. The burn pit flare tip 24 is surrounded by a section 42 of precast refractory tile blocks (monolithics), or in certain designs formed in place with cast refractory concrete. The wing walls 32, 34 are adjoined to the burner wall 30, so that the refractory brick layer of each wing wall 32, 34 meets the refractory brick layer of the burner wall 30 at an obtuse angle to form an inside corner 35.

For structural support, metal anchors and joint reinforcements are used throughout the structure. Typically, joint reinforcements include longitudinal metal rods, for instance formed as truss-mesh or ladder mesh, in the mortar beds between horizontal courses of brick (not shown). In addition, anchors 46 are used as reinforcement between the retaining wall layer 36 and the cast refractory concrete layer 38, and anchors 48 are used as reinforcement between the cast refractory concrete layer 38 and the refractory brick layer 40. Similar anchor structures are typically included to tie the concrete and brick layers of the wing walls 32, 34. In addition, conventional designs include expansion joints, for instance, where the wall meets the floor, and above the tip at the location where the wall changes orientation from vertical to sloped.

Figure 9:
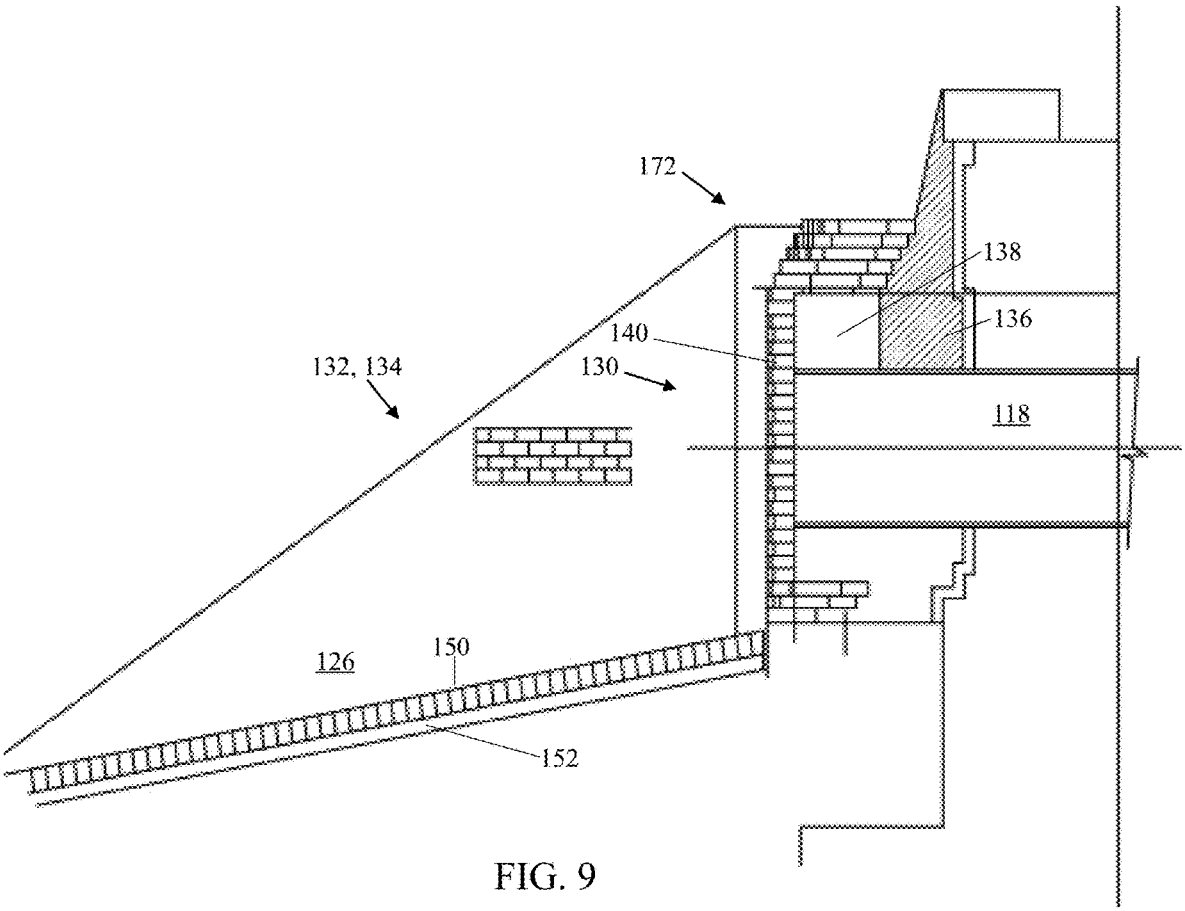
FIG. 9 is a front view of a portion of the wall of the burn pit flare tip structure of FIG. 8.
Figure 10:
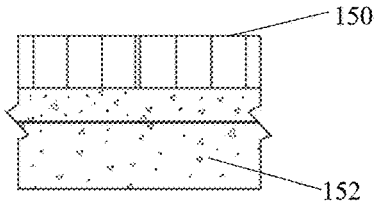
FIG. 10 is a detail section view of the floor of the structure shown in FIG. 8.
Figure 11:
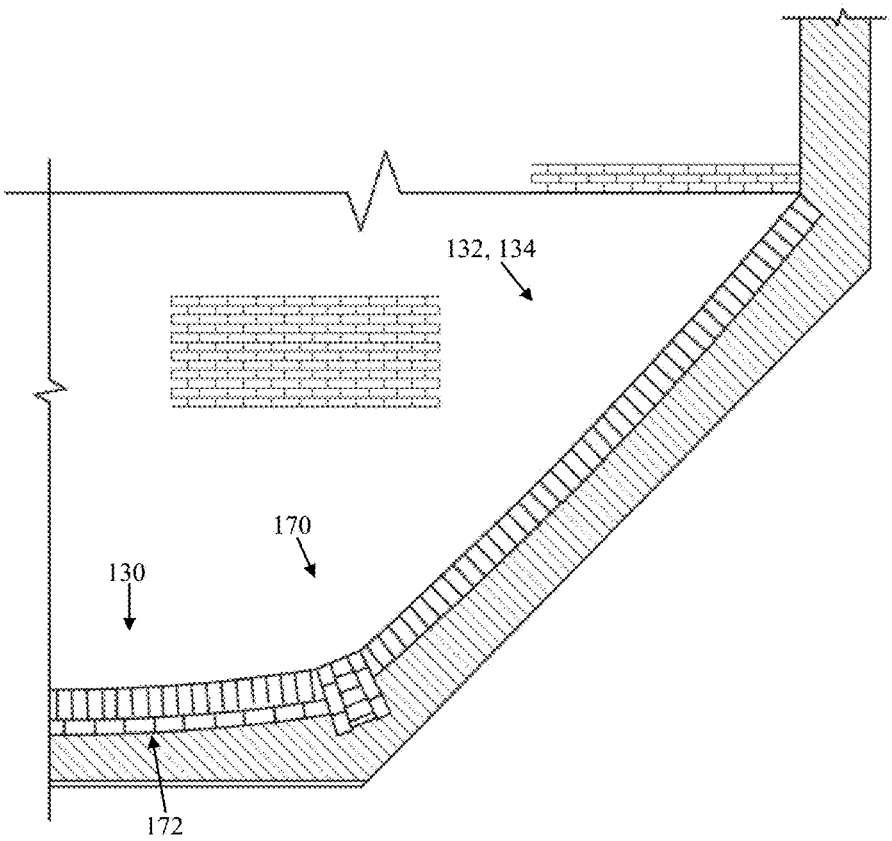
FIG. 11 is a plan view of the wall of the burn pit flare tip structure of FIG. 8.
Figure 12:
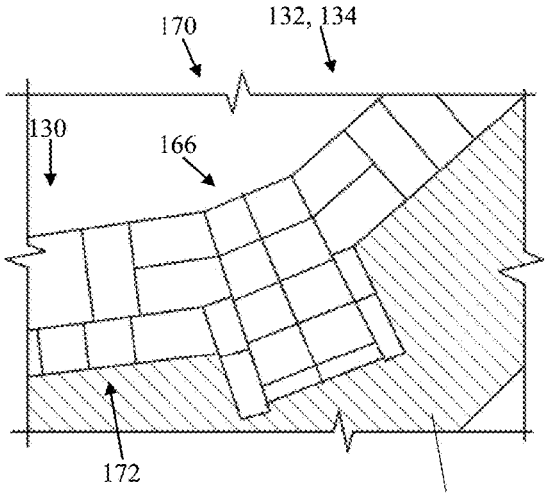
FIGS. 12 and 13 are detailed views of the corner between walls at different layers.
Figure 13:
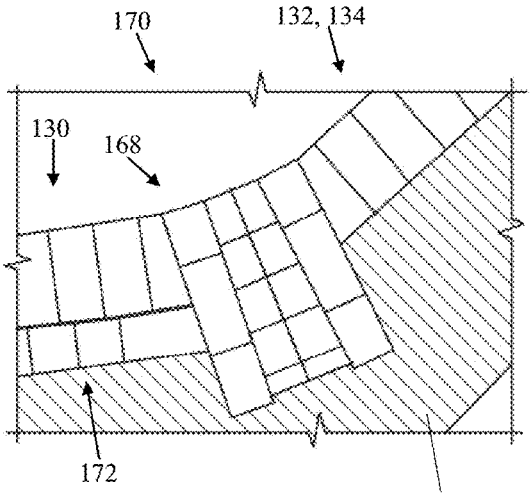
Figure 14:
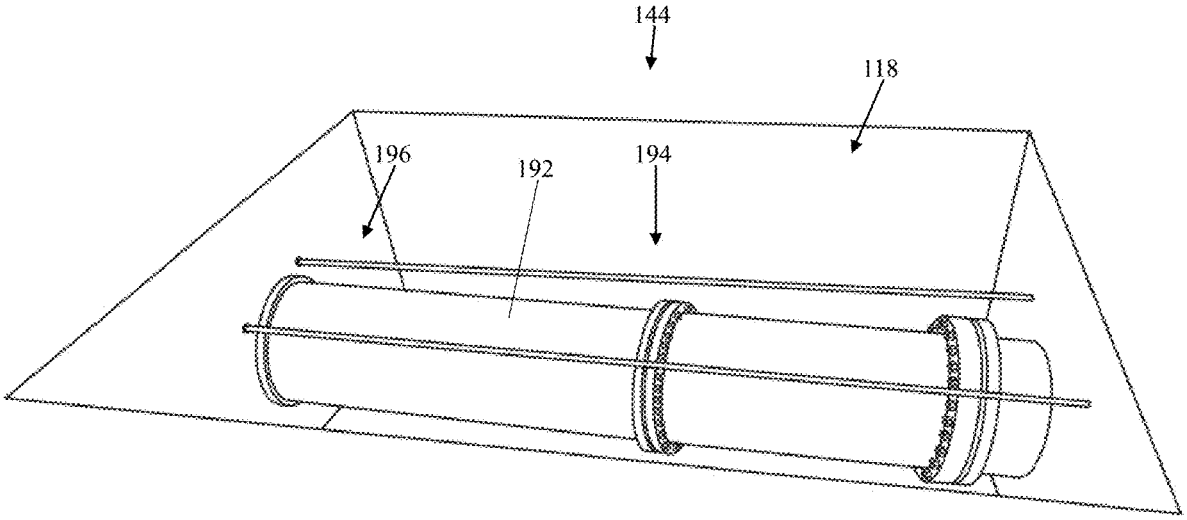
FIG. 14 is a view of a utility box of the burn pit flare tip structure of FIG. 8.
Figure 15:
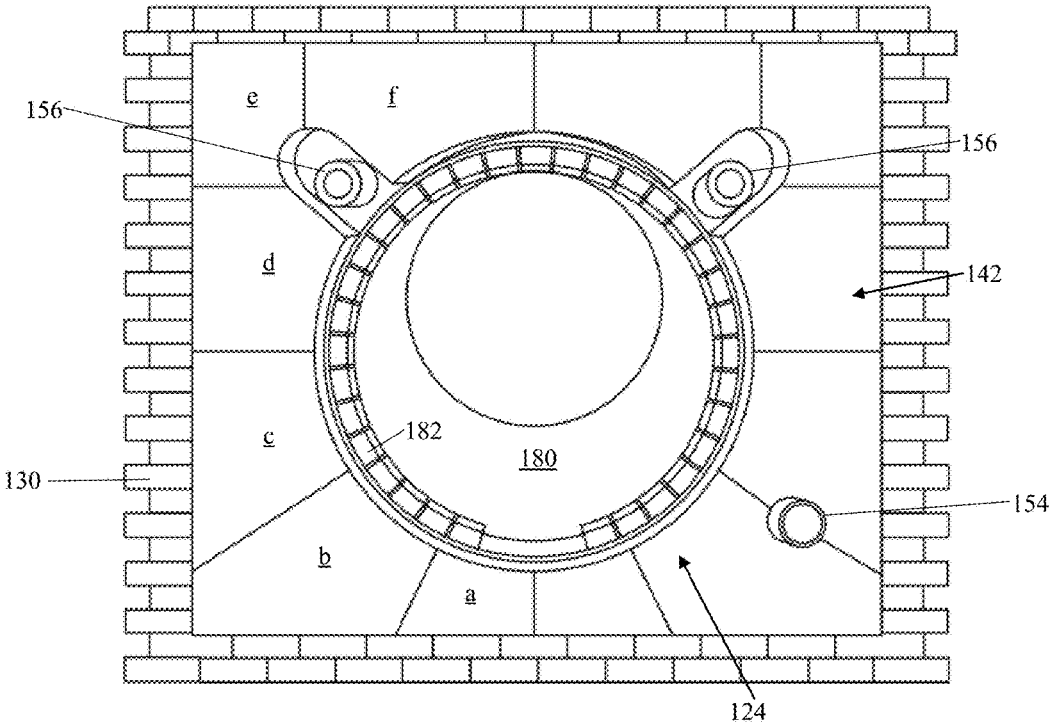
FIG. 15 is a front view of the burn pit flare tip of FIG. 8.

With reference to FIGS. 8-15, a burn pit flare tip structure 122 of the present disclosure is depicted, where FIG. 8 is a front isometric view, FIG. 9 is a section view, FIG. 10 is a detail section view of the floor, FIG. 11 is a plan view of the wall, FIGS. 12 and 13 are detailed views of the corner between walls at different layers, FIG. 14 is a top view of a utility box, and FIG. 15 is a front view of the flare tip and surrounding wall.

Similar to the structure shown and described with respect to FIGS. 1-7, the burn pit flare tip structure 122 is positioned in similar location as the burn pit flare tip structure 22 shown in FIG. 1. The burn pit flare tip structure 122 includes several design modifications that enable more robust burn pit flare tip structures that is thermally and structurally sound. The burn pit flare tip structure 122 is capable of withstanding for prolonged periods of time under the high temperatures up to and exceeding 1800° C. with wide thermal gradients that occur during upset operation conditions, which are known to degrade the masonry structure in the conventional designs requiring repairs or reconstruction.

The burn pit flare tip structure 122 includes the burner shaft 118 (FIGS. 9, 14) extending substantially horizontally from source of a combustion material to a burn pit flare tip 124 (FIGS. 8, 15) which is exposed to an initial containment area 126 (FIGS. 8, 9). The initial containment area 126 is sloped away from the flare tip so that liquids drain from to the pool area (which is sloped about 2.5-3.5% to the center depression), typically through a flow breaker region (not shown). The ground surface of the initial containment area 126 is formed by a refractory brick layer 150 and a reinforced concrete layer 152 atop compressed, graded and sloped fill. (FIGS. 9, 10). In the arrangement shown the embodiment of FIG. 10, the brick layer is formed with the stretcher face of the bricks on the surface 152, with the header faces and beds of the bricks adjacent to one another.

In the present embodiments depicted in FIGS. 8 and 11, the adjoined walls form a continuous curved wall including partial trapezoid shape with curved inside corners 170, rather than obtuse angles as in the conventional design. In particular, surrounding the flare tip 124 is a burner wall 130 (for instance corresponding to the shorter base of the trapezoidal-like shape with curved inside corners 170), a first wing wall 132 on a first side of the burner wall 130, and a second wing wall 134 on a second side of the burner wall 130 (wherein the wing walls 132, 134 corresponding to the legs of the partial trapezoidal-like with curved inside corners 170). The intersection 170 between the burner wall 130 and the wing walls 132, 134 are contoured, which can be formed by plural obtuse angles that vary at different layers to approximate the curved shape (FIGS. 12, 13), and are typically identical. The wing walls 132, 134 have a height that decreases to the floor of the containment area 126. For example, to accommodate a burner shaft having an outside diameter of about 0.7-1, 0.75-1, 0.8-1, 0.7-0.9, 0.75-0.9, or 0.8-0.9 meters, suitable dimensions for the refractory brick walls include: a burner wall 130 height of about 2-2.8, 2-2.6 or 2-2.2 meters; a burner wall 130 length of about 4-6, 4-5 or 4-4.7 meters; wing walls 132, 134 of approximately equal height dimensions having a maximum height where it meets the burner wall 130 at the curved inside corner intersection 170 similar to the height of the burner wall, and sloping to the ground level or within about 0-1 or 0-0.5 meters from the ground level; and wing walls of approximately equal length dimensions of about 5-7, 5-6.5 or 5-6 meters.

Referring to FIGS. 8, 9 and 15, the burner wall 130 is generally a vertical wall portion below and partially above the flare tip 124. The burner wall 130 can be a generally vertical or inclined wall section below and partially above the flare tip, for example vertical (gradient=∞) or having a slight gradient inclined away from the face. In certain embodiments the height to depth gradient Y:X of the burner wall 130 below and partially above the flare tip is about ∞-8:1, ∞-10:1 or ∞-12:1.

Above the vertical portion, the burner wall 130 includes a head portion including a stepped region 172. The head portion is formed of a plurality of stepped courses that slope away from the face (for example with 4-7 courses of refractory brick stepped back about 3-4 centimeters per course). For example this forms a height to depth gradient Y:X of about 5:2-3:2. Above the flare tip the stepped courses can be arranged so that the refractory brick are laid in a plane that generally corresponds to the remainder of the bricks in the structure, in contrast to conventional sloped designs in which the brick are laid in a plane that is at an angle relative to the remainder of the bricks in the structure. This stepped arrangement is distinct from conventional burner walls have either a fairly vertical wall portions above the surrounding area of the burn pit flare tip, or a sloped brick portion where the faces of the brick are in the same plane. The head portion integrating the stepped region 172 can serve to deflect flares that may contact the bricks therein, minimizing flare distance and containing flares to the front of the structure. In addition, the stepped portion contributes to the structural integrity by tying the face of the refractory masonry unit wall (including bricks and precast tile blocks) to the refractory concrete wall behind.

As shown in FIG. 9, the burner wall 130 includes an innermost retaining wall layer 136, typically adjacent to compacted earthen material forming the berm, a cast refractory concrete layer 138 and a refractory brick layer 140. The retaining wall layer 136 extends above the top of the brick layer 140 as shown in FIGS. 10 and 11, although other configurations are possible.

The burn pit flare tip 124 is surrounded by a section 142 of precast refractory tile blocks (monolithics), or in certain designs formed in place with cast refractory concrete (FIGS. 8, 15). The section 142 includes plural refractory monolithics, for instance shown as a, b, c, d, e and fin FIG. 15, which are shaped to form a square or rectangle around the flare tip 124. For instance as shown in FIG. 15, the bottom quarter includes three tile blocks a, b and c that surround a portion of the flare tip and have 30° angles between them (to form the 90° corner). The top quarter includes three tile blocks d, e and f, which are shaped to surround a portion of the flare tip and, when combined to form the top quarter, includes an elongated opening 156 to form cut-outs to accommodate pilot ignitors for initial ignition of the burn pit. A similar structure is on the top right quarter to accommodate the opening 156 on the other side. The bottom right corner is similar to the bottom left corner shown in FIG. 15, and includes an opening 154 to accommodate an air vent line for escape of air to ventilate the backside utility and maintenance box. Surrounding the section 142 are portions of the burner wall 130 including surround wall portions on either side of and above the section 142, and head portion including the stepped region 172 further above.

The masonry construction of the wall surrounding the outside dimeter of the burner shaft is configured and dimensioned to support the burner shaft. This is formed with precise tolerances, for instance, within less than 1, 0.8, 0.6 or 0.5 millimeters, in the opening of the cast refractory concrete layer 138. In certain embodiments, one or more layers of insulating material is provided between the outside dimeter of the burner shaft and the masonry of the wall surrounding said shaft including the refractory concrete and/or the refractory tile blocks. In certain embodiments suitable insulating material includes a matte material having a thickness of 0.3-0.8, 0.3-0.6, 0.4-0.8 or 0.4-0.6 millimeters.

In a preferred embodiment, the bricks layer 140 is installed relative to the cast refractory concrete layer 138, including the portion at the level of, above and below the tip 124, in the absence of metal anchors used to tie those layers together in conventional designs. In further embodiments the entire burner wall or the head portion of the burner is installed without metal anchors, and the stepped bricks wall is interlocked with the concrete using mortar (refractory) only. In a preferred embodiment, metal joint reinforcements are not installed in the mortar beds between courses of the brick layer 140. In further preferred embodiments, metal anchors are not installed to tie the bricks layer of each of the wing walls to the cast refractory concrete layer. In further embodiments the entireties of the wing walls are installed without metal anchors, wherein interlocking is accomplished with the concrete using mortar only. In further embodiments, metal joint reinforcements are not used in the mortar beds between courses of the brick layer of each of the wing walls.

Metal anchors used in conventional designs, for instance stainless steel wedge anchors, have thermal conductivity k value (Watts per meter-Kelvin) in the range of about 45, whereas refractory bricks have a k value in the range of about 1-3. In addition, stainless steel bolts expand in length based on the thermal expansion coefficient about 2.5%, whereas thermal expansion of refractory brick range from about 0.5-1.3%. These expansions and contractions can cause dislodging of the refractory brick, and the high conductivities can cause other degradations. By eliminating the metal anchors, different heat conductivities and thermal expansion concerns are avoided, enhancing the lifetime and robustness of the wall.

In addition, expansion joints, for instance formed of cardboard pieces of about 0.8-1.2 millimeter in thickness, are integrated between bricks on each throughout the refractory brick layer 140. For instance, the expansion joints are included on each course, and arranged so that they are between every second brick along a brick course. In addition, expansion joints can be added between refractory tile blocks in the section 142. The expansion joint accommodate thermal expansion and contraction that occurs in use of the burn pit, and protecting the burn pit tip.

The refractory brick used to form the layer 140 of the burner wall portion 130 can be, for example: 210-250, for instance, 230, millimeters in length; 64 millimeters in height and 114 millimeters in depth (although the size of the brick can vary as is known, and can be saw cut to necessary shape and size as is known during installation, for instance using a wet saw equipped with a diamond or cubic boron nitride). The beds correspond to the length by depth, the stretcher faces correspond to the length by height and the header faces correspond to the depth by height. Concerning the mortar beds and joints between adjacent bricks, conventional refractory bricks are laid beds and joints of up to 6 millimeters. In contrast, in the layer 140 of the burner wall portion 130, the mortar beds and head joints (longitudinal joints between adjacent bricks) does not exceed 3 millimeters, in certain embodiments does not exceed about 2.5 millimeters, for instance in the range of about 1.5-3, 1.5-2.5, or 1.6-2.4 millimeters.

The materials of construction for the brick and tile blocks that are used in the burn pit flare tip structures disclosed herein are formed of refractory materials. For example, the burner wall bricks can be formed of high-alumina high fired refractory bricks having about 70-80 w % $Al_2O_3$ and about 20-28 w % $SiO_2$, and also including about 0.05-0.2 wt % $Fe_2O_3$ and about 0.05-0.2 wt % $Na_2O$, with a bulk density of about 2.5-2.8 grams per cubic centimeter, a porosity of about 15-16%, a cold crushing strength (CCS) of about 100-120 Newtons per millimeters squared, a cold modulus or rupture (CMR) of about 15-20 Newtons per millimeters squared, a resistivity under load (RUL) at 0.5% deformation (T05) of at least about 1650-1700° C., a creep in compression (CR) at 0.2 Newtons per millimeters squared of 0.22-0.28 at 1600° C., a thermal shock resistance (TSR) of at least about 28-32 cycles; thermal expansion of about 0.7-0.9% at 1500° C., and thermal conductivity k value (Watts per meter-Kelvin) in the range of about 1.4-1.6 at 400-1000° C. The wing wall bricks can be formed of high-alumina refractory bricks having about 60-70 w % $Al_2O_3$ and about 30-36 w % $SiO_2$, and also including about 0.5-1.2 wt % $Fe_2O_3$, about 0.2-0.6 wt % MgO, about 0.5-1.2 wt % $TiO_2$, and about 0.2-0.4 wt % $Na_2O$, with a bulk density of about 2.4-2.7 grams per cubic centimeter, a porosity of about 14-15%, a cold crushing strength (CCS) of about 70-80 Newtons per millimeters squared, a cold modulus or rupture (CMR) of about 6-10 Newtons per millimeters squared, a resistivity under load (RUL) at 0.5% deformation (T05) of at least about 1600-1650° C., a creep in compression (CR) at 0.2 Newtons per millimeters squared of 0.10-0.20 at 1600° C., a thermal shock resistance (TSR) of at least about 28-32 cycles; thermal expansion of about 0.7-0.9% at 1400° C., and thermal conductivity k value (Watts per meter-Kelvin) in the range of about 1.3-1.6 at 400-1000° C. In addition, the mortar used for installation of the refractory bricks is a refractory mortar, such as a high alumina mortar, for example having about 65-75, 68-72 or 70 w % $Al_2O_3$ and about 15-25, 18-22 or 19 w % $SiO_2$.

With reference to FIGS. 11, 12 and 13, the intersection 170 of the burner wall and the wing walls are shown in detail, and also a top view of part of the stepped region 172. In the conventional design, the intersection of a burner wall and wing walls is an obtuse angle, as described above. According to the embodiments herein, contour is added so as to minimize the impact of direct exposure to flares. With a single obtuse angle, eddies in the flames lead to concentrated exposure. In the present embodiments, with a more contoured structure that uses plural obtuse angles in the brick construction that are offset in alternating brick courses, this detriment is minimized or eliminated. In addition, the intersection 170 facilitates and enables construction of one homogenous masonry structure that is self-anchoring and which enhances the overall robustness of the design to extend its useful lifetime to give prolonged continuous operations.

FIG. 11 shows the intersection of the burner wall 130 and the wing wall 132, 134. A contoured corner 170 is shown in FIGS. 12 and 13, where FIG. 12 shows a structure of a layer 162, and FIG. 13 shows a structure of a layer 164. At the face of the wall there are a pair of obtuse angles to enhance the contour compared to a single angle. The layers 162, 164 represent alternate masonry courses that form the contoured corner 170 and an inward facing wedge structure that ties into the concrete wall 138 and to provide outward face sections 166, 168 of layers 162, 164 respectively. The alternating layers 162, 164 and face sections 166, 168 provide the overall contour at the intersection 170 by a pair of obtuse angles that are offset and staggered by layer, rather than the single obtuse angle in the conventional designs. In addition, the region inwardly facing the concrete wall 138 forms a keystone with the alternating layers 162 and 164. An example of a layer 162 (FIG. 13) includes bricks cut to shape and laid in short courses in the direction of the wall 130, 132 (or 130, 134), with parallel courses installed toward the concrete wall 138, and having bricks cut to shape (trapezoidal shapes of increasing sizes) and arranged transversely between the longitudinal courses. The face 166 of the layer 162 is formed by the ends of the longitudinal courses and the face of the brick cut to trapezoidal shape (the short trapezoidal base of the shortest brick in the transverse course). An example of a layer 164 (FIG. 13) includes bricks cut to shape and laid in adjacent courses perpendicular to the direction of the wall 130, 132 (or 130, 134), extending to the concrete wall 138. The face 168 of the layer 164 is formed by the faces of the adjacent transversely laid bricks (the short base of the right trapezoid shape). The arrangement described permits the layers 162 and 164 to be mortared to the concrete wall 138 without metal anchors. Inset regions can be provided in the concrete wall to accommodate the bricks. These inset regions can be pre-formed in the concrete when it is cast in place.

In additional embodiments, an extractable burn pit flare tip is provided. With reference to FIGS. 14 and 15, a top view of a utility box and a front view of an extractable burn pit flare tip are shown. The burner shaft 118 includes a drop-out spool 192 with a flare tip end 194 and an upstream end 196, wherein the upstream end 196 is connected to the remainder of the burner shaft 118 (via a flange connection, for instance via one or more intermediate drop-out spools) that is ultimately in fluid communication with the hydrocarbon liquids or mixed liquid/vapor streams for combustion. The flare tip end 196 forms the burn pit flare tip 124 which is exposed to the initial containment area 126. An extractable sleeve 180 is provided at the flare tip end 196 of the drop-out spool 192 and is held in place by retaining clips 184. The sleeve 180 can be formed of suitable metal material (similar to the burner shaft 118) capable of withstanding the heat extremities, and is configured and dimensioned to fit within the flare tip end 194 of the drop-out spool 192 forming part of the burner shaft 118. In this manner, the sleeve 180 can be removed for replacement and/or maintenance without disrupting the connection of the drop-out spool 192 to the remainder of the burner shaft 118.

The method and system of the present invention have been described above and in the attached drawings; however, modifications will be apparent to those of ordinary skill in the art and the scope of protection for the invention is to be defined by the claims that follow.

The invention claimed is:

1. A flare tip structure for a burn pit flare tip that is exposed comprising:

a burner shaft having a first end coupled to the exposed burn pit flare tip, wherein during operation the burner shaft is in fluid communication at a second end with a source of combustible material;

a burner wall having an exposed surface of refractory bricks and refractory precast units, and having the flare tip extending and exposed therefrom, the burner wall being oriented generally vertically or slightly inclined, being in a base planar direction, and including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall;

a first wing wall and second wing wall each having an exposed surface and including a refractory concrete wall and an adjacent refractory brick wall forming part of the exposed surface of the wing walls, wherein the first and second wing walls are contiguous with, and on opposing sides of, the burner wall, which are each of decreasing height as the distance from the burner wall increases, the first and second wing walls are oriented generally vertically, the first and second wing walls have planar orientations that differ from the base planar direction so that the contiguous burner wall and first and second wing walls form an initial containment area, and the intersection of the first wing wall and the burner wall, and the intersection of the second wing and the burner, wall comprises a plurality of obtuse angles to form a contoured inside corner;

and a ground surface of the initial containment area between the contiguous tip support wall portion and the first and second wing wall portions, and the pit discharge area.

2. The structure as in claim 1, wherein the head portion of the tip support wall portion is inclined away from the end of the burn pit flare tip by stepped courses of refractory brick.

3. The structure as in claim 1, wherein the burner wall or the head portion of burner wall is formed without metal anchors.

4. The structure as in claim 3, wherein the first and second wing walls are formed without metal anchors.

5. The structure as in claim 3, wherein refractory bricks in the burner wall are separated by cardboard expansion joints of a thickness in the range of 0.8 to 1.2 millimeters arranged at cross joints between every two bricks.

6. The structure as in claim 5, wherein the overall joint thicknesses for the bed joints and the cross joints are in the range of 1.6 to 2.4 millimeters.

7. The structure as in claim 1, wherein the exposed burn pit flare tip comprises an extractable sleeve that is inserted within the end of the burner shaft and attached to an outside perimeter of the burner shaft with retaining clips.

8. A flare tip structure for a burn pit flare tip that is exposed comprising:

a burner shaft having a first end coupled to the exposed burn pit flare tip, wherein during operation the burner shaft is in fluid communication at a second end with a source of combustible material;

a burner wall having an exposed surface of refractory bricks and refractory precast units, and having the flare tip extending and exposed therefrom, the burner wall being is oriented generally vertically or slightly inclined, being in a base planar direction, and the tip support wall including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall, wherein the head portion of the tip support wall portion is inclined away from the end of the burn pit flare tip by stepped courses of refractory brick, wherein the burner wall or the head portion of burner wall is formed without metal anchors, wherein refractory bricks in the burner wall are separated by cardboard expansion joints of a thickness in the range of 0.8 to 1.2 millimeters arranged at cross joints between every two bricks, and wherein the overall joint thicknesses for the bed joints and the cross joints are in the range of 1.6 to 2.4 millimeters;

a first wing wall and a second wing wall each having an exposed surface and including a refractory concrete wall and an adjacent refractory brick wall forming part of the exposed surface of the wing walls, the first and second wing walls being contiguous with, and on opposing sides of, the burner wall, which are each of decreasing height as the distance from the burner wall increases, and wherein the first and second wing walls are each oriented generally vertically, and wherein the planar orientations of the first and second wing walls differ from the base planar direction so that the contiguous burner wall and first and second wing walls form an initial containment area;

and a ground surface of the initial containment area between the contiguous tip support wall portion and the first and second wing wall portions, and the pit discharge area.

9. The structure as in claim 8, wherein the first and second wing walls are formed without metal anchors.

10. The structure as in claim 8, wherein the intersection of the wing walls and the burner wall comprises a plurality of obtuse angles to form a contoured inside corner.

11. The structure as in claim 8, wherein the head portion of the tip support wall portion is inclined away from the end of the burn pit flare tip by stepped courses of refractory brick.

12. The structure as in claim 8, wherein the exposed burn pit flare tip comprises an extractable sleeve that is inserted within the end of the burner shaft and attached to an outside perimeter of the burner shaft with retaining clips.

13. A flare tip structure for a burn pit flare tip that is exposed comprising:

a burner shaft having a first end coupled to the exposed burn pit flare tip, wherein during operation the burner shaft is in fluid communication at a second end with a source of combustible material, and wherein the exposed burn pit flare tip comprises an extractable sleeve that is inserted within the end of the burner shaft and attached to an outside perimeter of the burner shaft with retaining clips;

a burner wall having an exposed surface of refractory bricks and refractory precast units, and having the flare tip extending and exposed therefrom, the burner wall being oriented generally vertically or slightly inclined, being in a base planar direction, and including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall;

a first wing wall and second wing wall each having an exposed surface and including a refractory concrete wall and an adjacent refractory brick wall forming part of the exposed surface of the wing walls, wherein the first and second wing walls are contiguous with, and on opposing sides of, the burner wall, which are each of decreasing height as the distance from the burner wall increases, the first and second wing walls are oriented generally vertically, and the first and second wing walls have planar orientations that differ from the base planar direction so that the contiguous burner wall and first and second wing walls form an initial containment area;

and a ground surface of the initial containment area between the contiguous tip support wall portion and the first and second wing wall portions, and the pit discharge area.

14. A flare tip structure for a burn pit flare tip that is exposed comprising:

a burner shaft having a first end coupled to the exposed burn pit flare tip, wherein during operation the burner shaft is in fluid communication at a second end with a source of combustible material, wherein the exposed burn pit flare tip comprises an extractable sleeve that is inserted within the end of the burner shaft and attached to an outside perimeter of the burner shaft with retaining clips;

a burner wall having an exposed surface of refractory bricks and refractory precast units, and having the flare tip extending and exposed therefrom, which is oriented generally vertically or slightly inclined, being in a base planar direction, and tip support wall including a refractory concrete wall having an opening configured and dimensioned for the burner shaft, a section of refractory tile blocks surrounding the exposed burn pit flare tip, adjacent to the refractory concrete wall and forming part of the exposed surface of the burner wall, surround wall portions on either side of the section of refractory tile blocks and immediately above the section of refractory tile blocks, adjacent to the refractory concrete wall and forming part of the exposed surface of the burner wall, and a head portion above the surround wall portions, adjacent to the refractory concrete wall and forming part of the exposed surface of the burner wall, and a first and second wing walls each having an exposed surface and including a refractory concrete wall and an adjacent refractory brick wall forming part of the exposed surface of the wing walls, the first and second wing walls being contiguous with, and on opposing sides of, the burner wall, which are each of decreasing height as the distance from the burner wall increases, and wherein the first and second wing walls are each oriented generally vertically, and wherein the planar orientations of the first and second wing walls differ from the base planar direction so that the contiguous burner wall and first and second wing walls form an initial containment area;

and a ground surface of the initial containment area between the contiguous tip support wall portion and the first and second wing wall portions, and the pit discharge area, wherein the intersection of the wing walls and the burner wall comprises a plurality of obtuse angles to form a contoured inside corner, wherein the head portion of the tip support wall portion is inclined away from the end of the burn pit flare tip by stepped courses of refractory brick;

wherein the burner wall or the head portion of burner wall is formed without metal anchors;

wherein refractory bricks in the burner wall are separated by cardboard expansion joints of a thickness in the range of 0.8 to 1.2 millimeters arranged at cross joints between every two bricks, and wherein the overall joint thicknesses for the bed joints and the cross joints are in the range of 1.6 to 2.4 millimeters.

15. The structure as in claim 14, wherein the first and second wing walls are formed without metal anchors.

* * * * *